US007810572B2

(12) United States Patent
Brandt et al.

(10) Patent No.: US 7,810,572 B2
(45) Date of Patent: Oct. 12, 2010

(54) METHOD FOR DELIVERING A MULTI PHASE MIXTURE AND PUMP INSTALLATION

(75) Inventors: Jens Uwe Brandt, Rinteln (DE); Gerhard Rohlfing, Hille (DE); Dietrich Mueller-Link, Pollhagen (DE)

(73) Assignee: Joh. Heinr. Bornemann GmbH, Obernkirchen (DE)

( * ) Notice: Subject to any disclaimer, the term of this patent is extended or adjusted under 35 U.S.C. 154(b) by 976 days.

(21) Appl. No.: 10/595,477

(22) PCT Filed: Oct. 21, 2004

(86) PCT No.: PCT/DE2004/002353

§ 371 (c)(1),
(2), (4) Date: Apr. 21, 2006

(87) PCT Pub. No.: WO2005/045189

PCT Pub. Date: May 19, 2005

(65) Prior Publication Data

US 2008/0210436 A1 Sep. 4, 2008

(30) Foreign Application Priority Data

Oct. 27, 2003 (DE) ..... 103 50 226

(51) Int. Cl.
*E21B 43/40* (2006.01)

(52) U.S. Cl. ..... 166/369; 166/68.5; 166/105.5; 417/77; 417/79; 95/243; 95/155

(58) Field of Classification Search ..... 166/267, 166/68.5, 105.5, 369; 210/170.01, 170.07, 210/188; 96/182, 155; 95/241, 243; 417/77, 417/79, 88

See application file for complete search history.

(56) References Cited

U.S. PATENT DOCUMENTS 1,623,239 A * 4/1927 Galbreath ..... 417/53

(Continued)

FOREIGN PATENT DOCUMENTS

EP 0 437 070 A1 7/1991

(Continued)

OTHER PUBLICATIONS

Zhujun et al., "Progressive Cavity Pump-Jet Pump Production Method for Lateral Directional Drilling", SPE 54361, Apr. 20, 1999, XP 002319449.

Carvalho, P. et al., "Modeling a Jet Pump with an ESP for Production of Gassy Petroleum Wells", SPE 48934, Sep. 27, 1998, XP 002319450.

(Continued)

*Primary Examiner*—David J Bagnell
*Assistant Examiner*—Robert E Fuller
(74) *Attorney, Agent, or Firm*—Andrew M. Calderon; Roberts Mlotkowski Safran & Cole, P.C.

(57) ABSTRACT

The object of the invention is to improve delivery of the multi-phase mixture, in particular hydrocarbons from a well, and to limit the free gas volume. According to the invention, this object is attained in that a partial liquid flow (13) is split off on the pressure side from the main delivery flow and guided to the high-pressure side of at least one ejector pump (2) arranged on the suction side as an auxiliary delivery device. The pump installation provides a feed line (7) connecting the pressure chamber of the displacement pump (1) with the high-pressure side of at least one ejector pump (2), whereby the ejector pump (2) is arranged on the suction side in the delivery direction of the displacement pump (1).

25 Claims, 1 Drawing Sheet

U.S. PATENT DOCUMENTS

| | | | | | |
|---|---|---|---|---|---|
| 2,080,622 | A | * | 5/1937 | McMahon | 166/105.5 |
| 2,651,259 | A | * | 9/1953 | Brush | 417/80 |
| 3,709,292 | A | * | 1/1973 | Palmour | 166/68 |
| 4,066,123 | A | * | 1/1978 | Skinner et al. | 166/68.5 |
| 4,294,573 | A | | 10/1981 | Erickson et al. | |
| 4,381,175 | A | | 4/1983 | Erickson et al. | |
| 4,603,735 | A | | 8/1986 | Black | |
| 4,718,486 | A | | 1/1988 | Black | |
| 4,848,471 | A | * | 7/1989 | Bencze | 166/335 |
| 5,156,537 | A | | 10/1992 | Massinon | |
| 5,302,294 | A | * | 4/1994 | Schubert et al. | 210/702 |
| 5,624,249 | A | | 4/1997 | Rohlfing | |
| 6,007,306 | A | * | 12/1999 | Vilagines | 417/307 |
| 6,260,627 | B1 | * | 7/2001 | Rivas | 166/369 |
| 7,077,207 | B2 | * | 7/2006 | Stark et al. | 166/369 |
| 7,093,665 | B2 | * | 8/2006 | Dass | 166/380 |
| 2003/0085036 | A1 | | 5/2003 | Curtis et al. | |
| 2004/0104023 | A1 | * | 6/2004 | Stark et al. | 166/68.5 |
| 2005/0000689 | A1 | * | 1/2005 | Peleanu et al. | 166/279 |

FOREIGN PATENT DOCUMENTS

| | | | |
|---|---|---|---|
| EP | 0 699 276 | A | 3/1996 |
| EP | 0 702 156 | A1 | 3/1996 |
| EP | 1 243 748 | A1 | 9/2002 |
| GB | 2 264 147 | A | 8/1993 |

OTHER PUBLICATIONS

Maurischat R, "Vereinfachnung Von Pumpensystemen—Eine Moeglichkeit Zur Steigerung Der Betreibssicherheit", Industriepumpen+ Kompressoren, Vulkan Verlag, Essen, DE, vol. 6, No. 4, Dec. 2000, pp. 264-268, XP 000976198, ISSN: 0947-0654.

Brian Nesbit, "Guide to European Pumps & Pumping", 2000, pp. 129-130.

* cited by examiner

METHOD FOR DELIVERING A MULTI PHASE MIXTURE AND PUMP INSTALLATION

FIELD OF THE INVENTION

The invention relates to a method for delivering multi-phase mixtures, in particular hydrocarbons from a well, with a displacement pump through which the multi-phase mixture is pumped, and a pump installation with a displacement pump for delivering multi-phase mixtures with a suction line and a pressure chamber, whereby the suction line discharges in particular into a well.

BACKGROUND OF THE INVENTION

Hydrocarbon delivery with multi-phase pumps installed on the surface, generally in the vicinity of the well, is an economical, sufficiently reliable and efficient technology for delivery from weak springs and for increasing the degree of deoiling. Multi-phase pumps are known per se, e.g., from EP 0 699 276 A1, to which reference is made in its entirety, and the disclosure of which is incorporated into the application. Pressure reductions on the solar head to approx. 2-5 bar are typical for hydrocarbon delivery, e.g., crude oil and natural gas delivery; lower head pressures are generally not very economical because of the volume expansion of the gas proportion and the increasing construction expenditure resulting therefrom.

SUMMARY OF THE INVENTION

In view of the above, the invention provides a method and a pump installation with which conveying the multi-phase mixture is improved and, at the same time, the required construction expenditure for the pump installation is limited.

According to the invention, a partial liquid flow is split off on the pressure side from the main delivery flow and guided to the high-pressure side of at least one ejector pump arranged on the suction side of the displacement pump as an auxiliary delivery device. A feed line connects the pressure chamber of the displacement pump with the high-pressure side of at least one ejector pump, and the ejector pump is arranged on the inlet side in the delivery direction of the displacement pump.

The pressure liquid used to drive the ejector pump circulates between the ejector pump and the displacement pump, in particular embodied as a multi-phase pump, without any permanent contamination of the delivery mixture. In addition, the energy supply of the ejector pump is ensured without an external energy source, in particular a hydraulic energy source, having to be provided.

Due to the suitable design of the ejector pump the displacement pump is fed with a moderate prepressure of, e.g., 2 bar, so that conveying the multi-phase mixture is improved and the free gas volume is limited at the same time. This results in a reduction of the construction expenditure of the displacement pump, which reduces the overall costs.

The ejector pump is advantageously arranged in or on the well, if the multi-phase mixture is delivered from a hydrocarbon source, in order to facilitate the intake of the hydrocarbons. Alternatively, the ejector pump can be arranged within the suction line.

Multi-phase mixtures are characterized by a high variability in their composition, whereby this is a multi-component mixture that can be present in several phases. The composition can change from almost 100% liquid phase to almost 100% gas phase, whereby there can also be large proportions of solids in a multi-phase mixture. In order to achieve a sufficient cooling and sealing of the displacement pump, a separation of gas phase and liquid phase is carried out in the displacement pump and the partial liquid flow to the ejector pump is split off from the separated liquid phase. For operating the ejector pump, a liquid is thus used that has a low gas proportion left and corresponds to the liquid phase of the delivered product. Therefore, there is no change or contamination of the delivery product through the use of the split-off partial liquid flow as an energy source for the ejector pump, and the displacement pump is always supplied on the suction side with a liquid proportion, so that there is a sufficient lubrication, cooling and sealing of the displacement pump.

A further development of the invention provides that a partial volume flow of the separated liquid phase is fed to the suction side of the displacement pump via a short-circuited line in a portioned manner, so that thus the supply does not take place exclusively via the ejector pump, but via a short-circuited line arranged preferably within the displacement pump housing. This renders it possible to reduce the danger of the displacement pump running dry.

A further development of the invention provides that after the partial liquid flow has been split off, this flow is guided through an additional separator for dividing gas phase from liquid phase, if the separation within the displacement pump has not been sufficient. The additional separator ensures that a liquid phase largely freed of the gas phase is fed to the ejector pump as a pressure liquid and energy source.

In order to provide a sufficiently high pressure level, in particular a constant pressure level, a booster pump is provided between the displacement pump and the ejector pump, which booster pump increases the delivery pressure.

In the pump installation according to the invention a feed line connects the pressure chamber of the displacement pump with the high-pressure side of at least one ejector pump. In this manner, the ejector pump is arranged on one side in the delivery direction of the displacement pump, in order to feed the displacement pump with a moderate prepressure. A partial liquid flow is thus guided from the pressure side of the displacement pump to the high-pressure side of one or more ejector pumps that are used as auxiliary delivery devices, which causes a particularly economical pressure increase on the suction side. As opposed to active components for increasing the prepressure, in which mechanical parts cause a pressure increase, e.g., in the form of down-hole pump technologies, such as beam pump, ESP, PCP or SSP, ejector pumps are built in an extremely simple manner and do not have any moving members. Not using mechanical components is advantageous in particular on account of the sometimes high abrasive properties of the delivered multi-phase mixture.

As a result of the low maintenance expenditure, the installations are more reliable and cost-efficient, especially since accessibility is limited in the area of a well and a repair is very complex. This causes long downtimes and economic efficiency problems for the operators of the installation. Advantageously, separation devices for dividing gas phase from liquid phase are embodied within the displacement pump housing in the pressure chamber, through which the gas phase of the multi-phase mixture is separated from the liquid phase, and only the liquid phase is used to drive the ejector pump.

In order to ensure that a certain liquid circulation is present for sealing, lubricating and cooling the displacement pump with a particularly long embodiment of the feed line, a short-circuited line is provided from the pressure-chamber side to the suction side of the displacement pump for the portioned feeding of the separated liquid phase.

For the improved division of liquid phase from gas phase, an additional separator is provided in the feed line. A return line of the separated gas phase, from additional separator, leads to the pressure line of the displacement pump. In this manner, the gas phase can be carried off together with the other delivery products for further processing.

A booster pump is arranged in the feed line, so that the separated liquid phase has an increased energy content.

It has proven advantageous for the displacement pump to be embodied as a screw pump, as screw pumps reliably deliver multi-phase mixtures, in particular with a high proportion of abrasive substances and highly fluctuating gas proportions, and offer advantages in terms of availability.

For assembly reasons it is advantageous to arrange the ejector pump in or on the well at the end of the suction line; alternatively, it is possible to arrange the ejector pump in a different location, e.g., in the suction line closer to the displacement pump or also in a well distant from the suction line.

DETAILED DESCRIPTION OF EMBODIMENTS OF THE INVENTION

Figure 1:
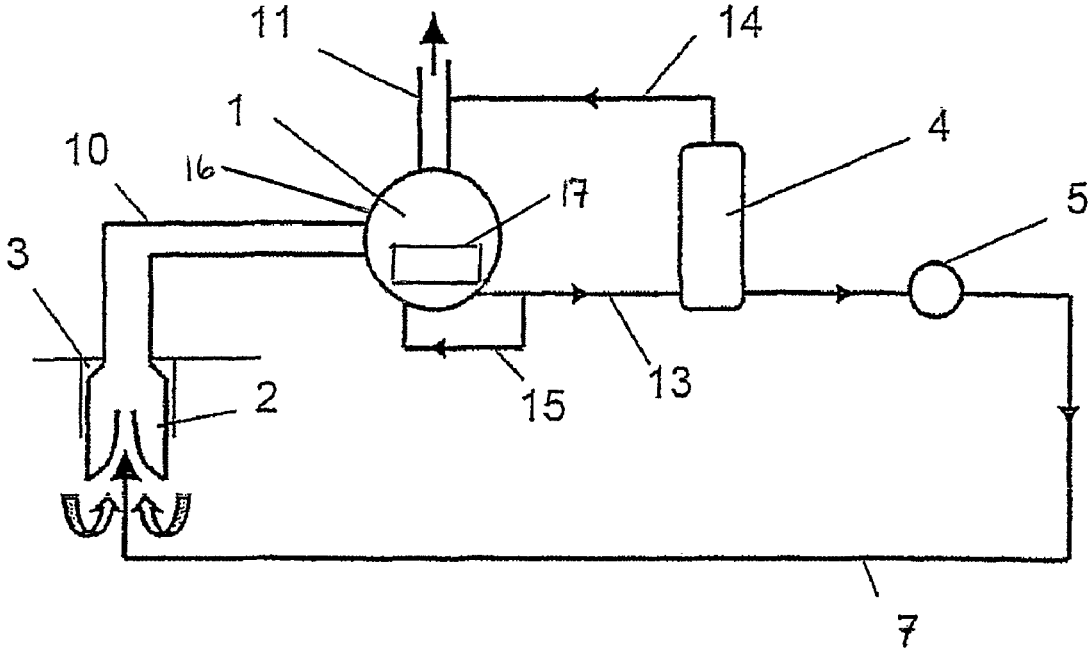
FIG. 1 shows an embodiment of the structure of a pump installation in accordance with the invention.

The core of the pump installation is a displacement pump 1 which is provided as a multi-phase pump and advantageously embodied as a screw pump. A suction line 10 is arranged on the suction side, which discharges into a well 3. An ejector pump 2 is arranged at the end of the suction line 10 within the well. The ejector pump 2 is oriented such that the high-pressure side of the ejector pump 2 faces in the direction of the suction side of the displacement pump 1, in order to load the displacement pump 1 with a prepressure.

The ejector pump 2, preferably embodied as a jet pump, is fed via a partial liquid flow 13 split off on the pressure side from the displacement pump 1. The partial liquid flow 13 is guided to the high-pressure side of the ejector pump 2 via a feed line 7.

The partial liquid flow 13 is split off from a separated multi-phase mixture, whereby a separation of the liquid phase and the gas phase takes place within the displacement pump. A predetermined amount of liquid phase is split off on the pressure side from the displacement pump 1, the other delivery product is guided through a pressure line 11 to further processing. An additional separator 4 is interposed for the further separation of gas phase and liquid phase of the multi-phase mixture, from which a return line 14 from the additional separator leads to the pressure line 11. In this manner, the liquid phase not required or the additional separated gas phase is guided to the pressure line 11.

A booster pump 5 is optionally provided in the feed line 7 in order to increase the energy level of the pressure liquid for the ejector pump 2.

A short-circuited line 15 is also optionally provided, via which a partial flow from the separated liquid is fed to the displacement pump 1 on the suction side, in order to always ensure a sufficient cooling and lubrication. The short-circuited line 15 can also be embodied within the displacement pump housing.

An auxiliary delivery device is made available through the circulation of a partial liquid flow within the pump installation, so that the displacement pump can better convey the multi-phase mixture as a result of the existing prepressure, whereby the volume expansion of the gas proportion is limited and the increased construction expenditure resulting therefrom is avoided. The simple structure of the ejector pump, without moving members, reduces the constructional expenditure and prevents downtimes on account of repairs resulting from the wear of mechanical components. In addition, no external energy source, mixed with the delivery product, is used as a pressure liquid, which can be an impediment with the subsequent processing of the delivery product. Furthermore, no separate pressure liquid is available in many cases, so that a constant usability of the pump installation is ensured.

Naturally, several ejector pumps 2 can be fed by one displacement pump 1.

The invention claimed is:

1. A method for delivering a multi-phase mixture from a well using a displacement pump through which the multi-phase mixture is pumped, comprising, on a pressure side, splitting off a partial liquid flow from a main delivery flow and guiding the split partial liquid flow to a high-pressure side of at least one ejector pump arranged on a suction side of the displacement pump as an auxiliary delivery device, and further comprising carrying out a separation of a gas phase and a liquid phase in the displacement pump, wherein the partial liquid flow to the at least one ejector pump is split off from the separated liquid phase.

2. The method according to claim 1, wherein the at least one ejector pump is arranged in or on the well.

3. The method according to claim 1, further comprising feeding a partial volume flow of the separated liquid phase in a portioned manner to a suction side of the displacement pump via a short-circuited line.

4. The method according to claim 1, further comprising, after the partial liquid flow has been split off, guiding the split off partial liquid flow through an additional separator for dividing a gas phase from a liquid phase.

5. The method according to claim 1, further comprising increasing a delivery pressure between the displacement pump and the at least one ejector pump by a booster pump.

6. The method according to claim 1, wherein the delivering the multi-phase mixture from the well is performed with an absence of a carrier fluid.

7. The method according to claim 1, further comprising feeding a partial volume flow of the separated liquid phase in a portioned manner to a suction side of the displacement pump via a short-circuited line, wherein:

the at least one ejector pump is arranged in or on the well, and the partial liquid flow is used to drive the at least one ejector pump and circulates between the at least one ejector pump and the displacement pump without any permanent contamination of the multi-phase mixture delivered from the well.

8. The method according to claim 1, wherein a liquid phase of the multi-phase mixture delivered from the well is used for operating the at least one ejector pump.

9. The method according to claim 1, wherein the at least one ejector pump is devoid of any moving members.

10. The method according to claim 1, wherein the delivering the multi-phase mixture from the well is performed using the partial liquid flow of a delivery product and with an absence of a separate carrier fluid.

11. The method according to claim 1, wherein the partial liquid flow has a gas proportion and a liquid phase, the liquid phase corresponds to a delivered product.

12. The method according to claim 1, wherein the partial liquid flow is guided to a jet pump.

13. A pump installation comprising a displacement pump for delivering multi-phase mixtures with a pump housing in which a pressure chamber is provided, at least one separation device is provided within the displacement pump housing to divide a gas phase from a liquid phase in the pressure chamber, a suction line configured to open out into a well, and a feed line connecting the pressure chamber of the displacement pump with a high-pressure side of at least one jet ejector pump arranged on a suction side in a delivery direction of the displacement pump and which guides the separated liquid phase to the at least one jet ejector pump.

14. The pump installation according to claim 13, wherein the at least one jet ejector pump is arranged in an area where the suction line opens out into the well in the delivery direction of the displacement pump.

15. The pump installation according to claim 13, further comprising a short-circuited line leading from a pressure-chamber side to the suction side of the displacement pump for portioned feeding of the separated liquid phase.

16. The pump installation according to claim 13, further comprising an additional separator arranged in the feed line for dividing the liquid phase from the gas phase.

17. The pump installation according to claim 16, further comprising a return line leading from the additional separator to a pressure line of the displacement pump.

18. The pump installation according to claim 13, further comprising a booster pump arranged in the feed line.

19. The pump installation according to claim 13, wherein the displacement pump is a screw pump.

20. The pump installation according to claim 13, wherein the at least one jet ejector pump is arranged in or on the well.

21. The pump installation according to claim 20, wherein the at least one jet ejector pump is at an end of the suction line.

22. The pump installation according to claim 13, wherein the displacement pump is operable to deliver the multi-phase mixtures in an absence of a carrier fluid.

23. The pump installation according to claim 13, further comprising:

a short-circuited line leading from a pressure-chamber side to the suction side of the displacement pump for portioned feeding of the separated liquid phase; and a return line leading from an additional separator to a pressure line of the displacement pump, wherein:

the at least one jet ejector pump is arranged in an area where the suction line opens out into the well in the delivery direction of the displacement pump, and the at least one jet ejector pump is devoid of any moving members.

24. The pump installation according to claim 13, wherein the displacement pump is operable to deliver the multi-phase mixtures using the separated liquid phase of a delivery product and with an absence of a separate carrier fluid.

25. The method according to claim 24, wherein the partial liquid flow is substantially free of a gas phase.

* * * * *